US012312717B2

(12) United States Patent
McFarland

(10) Patent No.: US 12,312,717 B2
(45) Date of Patent: May 27, 2025

(54) TUBULAR PROTECTIVE SLEEVE HAVING A KNITTED DUAL LAYER WALL AND METHOD OF CONSTRUCTION THEREOF

(71) Applicant: FEDERAL-MOGUL POWERTRAIN LLC, Northville, MI (US)

(72) Inventor: Scott McFarland, Phoenixville, PA (US)

(73) Assignee: Systems Protection Group US LLC, Northville, MI (US)

( * ) Notice: Subject to any disclaimer, the term of this patent is extended or adjusted under 35 U.S.C. 154(b) by 0 days.

(21) Appl. No.: 18/241,714

(22) Filed: Sep. 1, 2023

(65) Prior Publication Data

US 2025/0075382 A1 Mar. 6, 2025

(51) Int. Cl.
*D04B 1/22* (2006.01)
*D04B 1/14* (2006.01)

(52) U.S. Cl.
CPC ..... *D04B 1/225* (2013.01); *D04B 1/14* (2013.01); *D10B 2101/06* (2013.01); *D10B 2101/12* (2013.01); *D10B 2505/12* (2013.01)

(58) Field of Classification Search
CPC ..... D04B 1/22; D04B 1/225; D04B 1/102; D04B 7/28; D04B 7/32; D04B 9/38; D04B 9/44
See application file for complete search history.

(56) References Cited

U.S. PATENT DOCUMENTS 5,385,036 A * 1/1995 Spillane ..... A43B 1/04 66/196
5,651,847 A * 7/1997 Loeffler ..... D04B 1/16 66/196
5,735,145 A * 4/1998 Pernick ..... A61F 13/53 66/196
5,765,400 A * 6/1998 Roell ..... D04B 15/56 66/61
5,896,758 A * 4/1999 Rock ..... D04B 21/04 66/194
6,109,068 A 8/2000 Stoll et al.
6,151,928 A * 11/2000 Anyon ..... D04B 1/16 66/196

(Continued)

FOREIGN PATENT DOCUMENTS

CN 110010805 A 7/2019
CN 215152697 U 12/2021

(Continued)

*Primary Examiner* — Danny Worrell
(74) *Attorney, Agent, or Firm* — Dickinson Wright PLLC

(57) ABSTRACT

A thermal protection tubular sleeve includes a knitted inner wall having circumferentially continuous outer and inner surfaces. The circumferentially continuous inner surface bounds a cavity that extends lengthwise along a longitudinal central axis between opposite inner ends of the knitted inner wall. The tubular sleeve further includes a knitted outer wall having circumferentially continuous outer and inner surfaces. The knitted outer wall extends lengthwise about the longitudinal central axis between opposite outer ends and overlies the knitted inner wall. An intermediate yarn extends back and forth between and through knitted loops of the outer wall and knitted loops of the inner wall to connect the knitted outer wall and the knitted inner wall to one another.

12 Claims, 2 Drawing Sheets

(56) References Cited

U.S. PATENT DOCUMENTS

| | | | | |
|---|---|---|---|---|
| 6,156,406 | A * | 12/2000 | Rock | B32B 5/26 428/86 |
| 6,634,190 | B2 * | 10/2003 | Didier-Laurent | D04B 1/16 66/196 |
| 6,755,052 | B1 * | 6/2004 | Sytz | D04B 1/18 66/196 |
| 6,779,369 | B2 * | 8/2004 | Shepherd | D04B 1/126 66/196 |
| 7,240,522 | B2 * | 7/2007 | Kondou | D04B 15/48 66/195 |
| 7,937,973 | B2 * | 5/2011 | Sorensen | D04B 1/22 66/196 |
| 8,434,333 | B2 * | 5/2013 | Zhang | D04B 1/22 66/193 |
| 9,863,070 | B2 * | 1/2018 | Zhang | D04B 1/106 |
| 10,632,939 | B2 * | 4/2020 | Yoshimura | D03D 11/00 |
| 10,982,355 | B2 * | 4/2021 | Zhang | D04B 1/225 |
| 2009/0126413 | A1 * | 5/2009 | Sorensen | A61F 13/069 66/196 |
| 2018/0023222 | A1 | 1/2018 | Zhang et al. | |
| 2022/0294046 | A1 | 9/2022 | Pethick et al. | |
| 2023/0014166 | A1 | 1/2023 | Mehbubani et al. | |

FOREIGN PATENT DOCUMENTS

| | | | |
|---|---|---|---|
| JP | 2005129260 | A | 5/2005 |
| JP | 5078418 | B2 | 11/2012 |
| WO | 20020084001 | A1 | 10/2002 |
| WO | 20230288246 | A1 | 1/2023 |

* cited by examiner

TUBULAR PROTECTIVE SLEEVE HAVING A KNITTED DUAL LAYER WALL AND METHOD OF CONSTRUCTION THEREOF

BACKGROUND OF THE INVENTION

1. Technical Field

This invention relates generally to tubular protective sleeves for providing protection to elongate members contained therein, and more particularly to knitted tubular protective sleeves and to their method of construction.

2. Related Art

Single wall tubular sleeves are known for protecting elongate members against thermal conditions. The sleeves are commonly constructed from heat resistant yarns, such as silica, fiberglass, ceramic, basalt, aramid or carbon, to withstand relatively high temperatures. Although the sleeves are generally effective at providing a thermal barrier, the heat-resistant yarn that forms the outer wall of the sleeves is generally susceptible to damage. Accordingly, if protection against abrasion, impact or crush resistance is needed, an additional sleeve(s) is typically disposed in a separate operation about the single wall sleeve. Although this can prove helpful, it is generally labor intensive, bulky and costly.

SUMMARY OF THE INVENTION

In accordance with one aspect of the invention, a tubular sleeve for providing thermal protection about an elongate member, such as a bus bar of an electric vehicle battery pack, contained therein is provided. The tubular sleeve includes a knitted inner wall having a circumferentially continuous outer surface and a circumferentially continuous inner surface. The circumferentially continuous inner surface bounds a cavity that extends lengthwise along a longitudinal central axis between opposite inner ends of the knitted inner wall. The tubular sleeve further includes a knitted outer wall having a circumferentially continuous outer surface and a circumferentially continuous inner surface. The knitted outer wall extends lengthwise about the longitudinal central axis between opposite outer ends and overlies the knitted inner wall. Further, an intermediate yarn extends back and forth between the knitted outer wall and the knitted inner wall to connect the knitted outer wall and the knitted inner wall to one another.

In accordance with another aspect of the invention, the knitted inner wall is knitted entirely with a first yarn forming interlinked inner knitted stitches and the knitted outer wall is knitted entirely with a second yarn forming interlinked outer knitted stitches, the inner knitted stitches not knitted to the outer knitted stitches.

In accordance with another aspect of the invention, the intermediate yarn is the sole connection of the knitted inner wall to the knitted outer wall.

In accordance with another aspect of the invention, the intermediate yarn is knitted with a tuck stitch.

In accordance with another aspect of the invention, the inner knitted stitches and the outer knitted stitches are formed using weft knitted stitches.

In accordance with another aspect of the invention, the weft knitted stitches are jersey stitches.

In accordance with another aspect of the invention, the first yarn and the second yarn are multifilaments.

In accordance with another aspect of the invention, the first yarn and the second yarn can be provide as different types of material to optimized the desired performance attributes of the inner and outer walls.

In accordance with another aspect of the invention, the multifilaments consist of at least one of, fiberglass, ceramic, basalt, silica, slate, slag, aramid and carbon.

In accordance with another aspect of the invention, the intermediate yarn is a monofilament.

In accordance with another aspect of the invention, the monofilament is heat-set to impart a bias on both the knitted inner wall and the knitted outer wall to maintain the knitted inner wall and the knitted outer wall, and the cavity bounded by the inner wall, having a predetermined shape.

In accordance with another aspect of the invention, the opposite inner ends are radially aligned with the opposite outer ends in substantially flush relation.

In accordance with another aspect of the invention, a method of constructing a tubular textile sleeve for providing thermal protection about an elongate member is provided. The method includes knitting an inner wall having a circumferentially continuous outer surface and a circumferentially continuous inner surface, with the circumferentially continuous inner surface bounding a cavity extending lengthwise along a longitudinal central axis between opposite inner ends of the knitted inner wall, on two separate beds of a four-bed weft knitting machine. Further, knitting an outer wall in overlying relation with the inner wall, and knitting the outer wall having a circumferentially continuous outer surface and a circumferentially continuous inner surface, with the knitted outer wall extending lengthwise about the longitudinal central axis between opposite outer ends, on two separate beds, different from the two separate beds used to knit the inner wall, of the four-bed weft knitting machine. Further yet, knitting an intermediate yarn back and forth between the outer wall and the inner wall to connect the outer wall and the inner wall to one another.

In accordance with another aspect of the invention, the method can further include knitting the intermediate yarn using tuck stitches.

In accordance with another aspect of the invention, the method can further include knitting the inner wall and the outer entirely with multifilament yarns.

In accordance with another aspect of the invention, the method can further include providing the multifilament yarns consisting of at least one of, fiberglass, ceramic, basalt, silica, slate, slag, aramid and carbon.

In accordance with another aspect of the invention, the method can further include using monofilament yarns for the intermediate yarn.

In accordance with another aspect of the invention, the method can further include knitting the inner wall and the outer entirely with jersey stitches.

In accordance with another aspect of the invention, the method can further include knitting the intermediate yarn on all four beds of the four-bed knitting machine.

In accordance with another aspect of the invention, the method can further include shaping the inner wall and the outer wall to form the cavity having a desired shape, and then heat-setting the intermediate yarn to impart a bias on the inner wall and the outer wall to maintain the cavity in the desired shape.

BRIEF DESCRIPTION OF THE DRAWINGS

These and other aspects, features and advantages of the present invention will become more readily appreciated when considered in connection with the following detailed description of presently preferred embodiments and best mode, appended claims and accompanying drawings, in which:

DETAILED DESCRIPTION OF PRESENTLY PREFERRED EMBODIMENTS

Figure 1A:
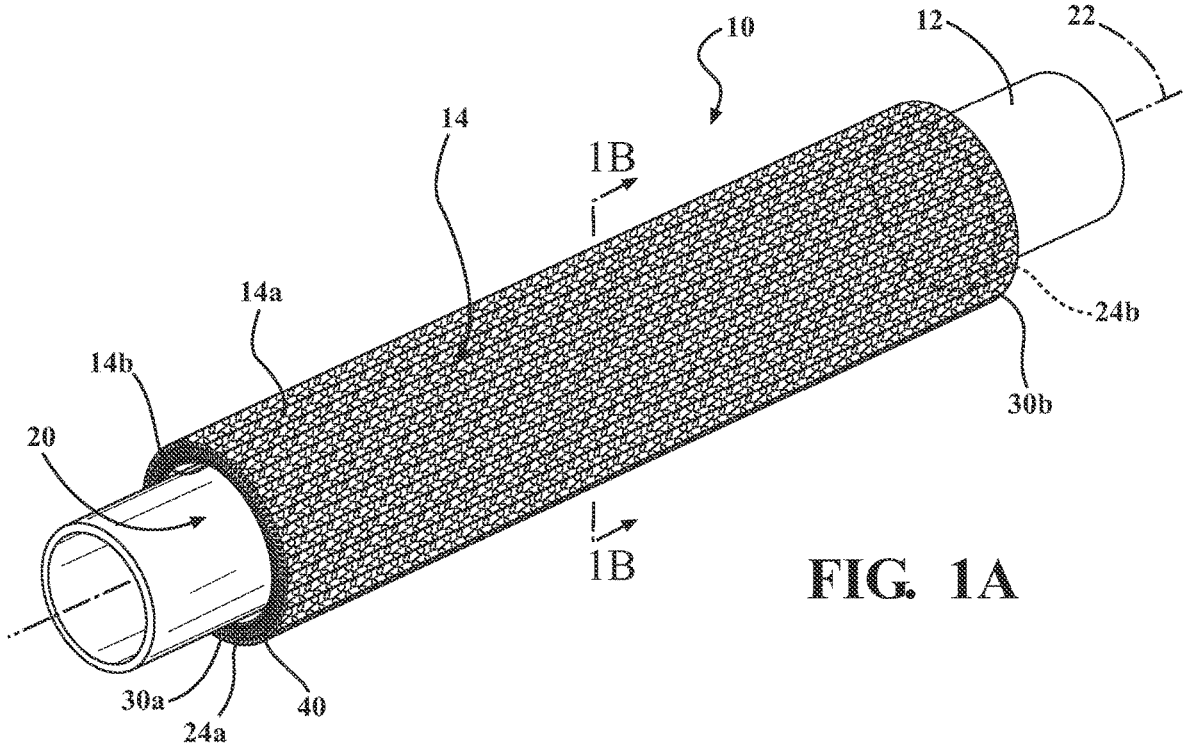
FIG. 1A is schematic perspective view of a knitted tubular sleeve constructed in accordance with one aspect of the invention shown with an elongate tubular member to be protected extending therethrough.
Figure 1B:
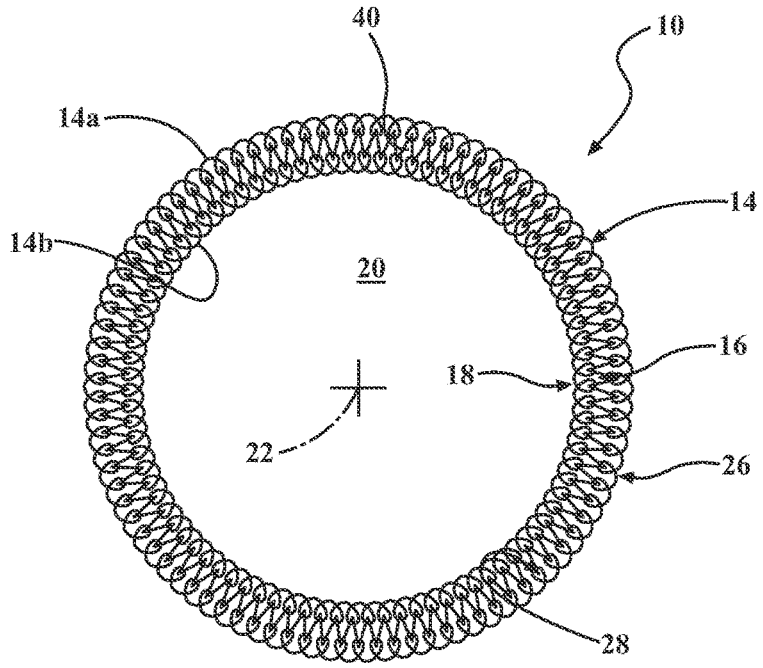
FIG. 1B is a schematic cross-sectional view of the knitted tubular sleeve taken generally along the line 1B-1B of FIG. 1.
Figure 1C:
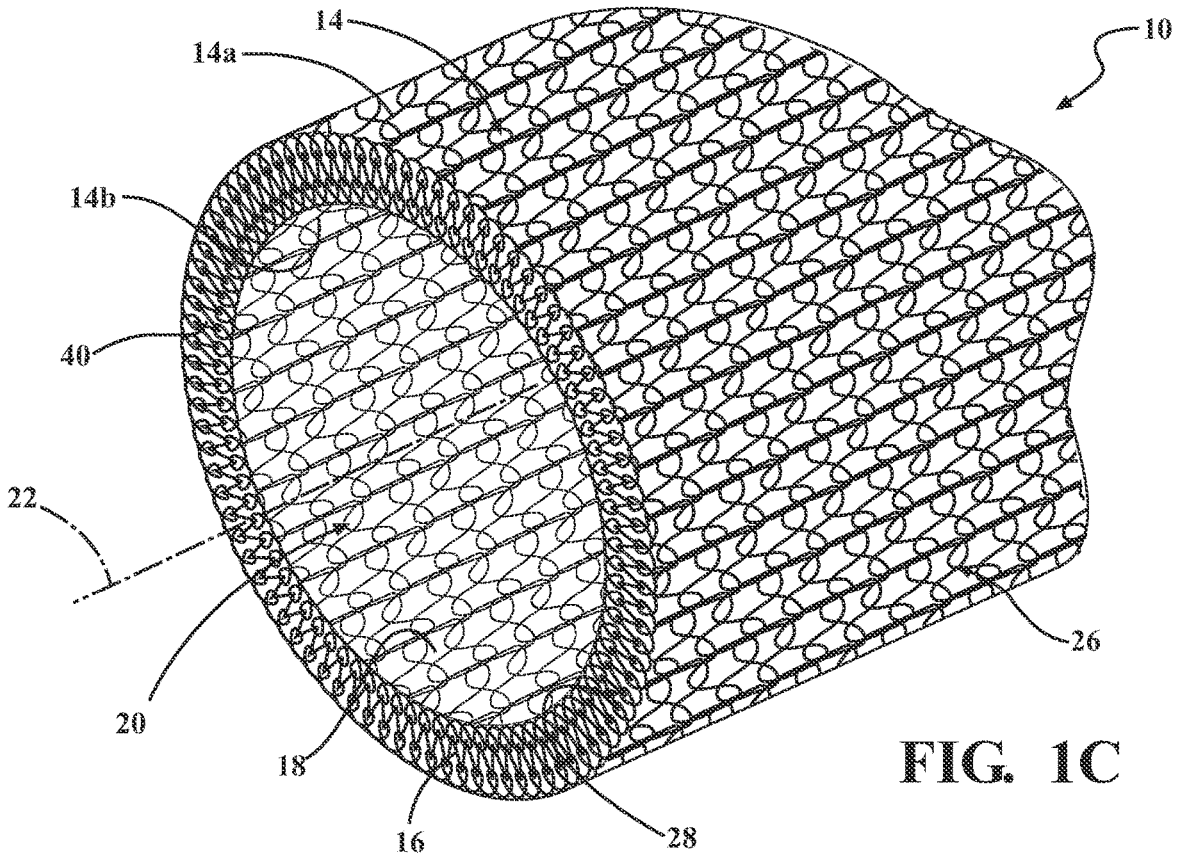
FIG. 1C is a schematic fragmentary perspective view of the knitted tubular sleeve of FIG. 1.
Figure 2:
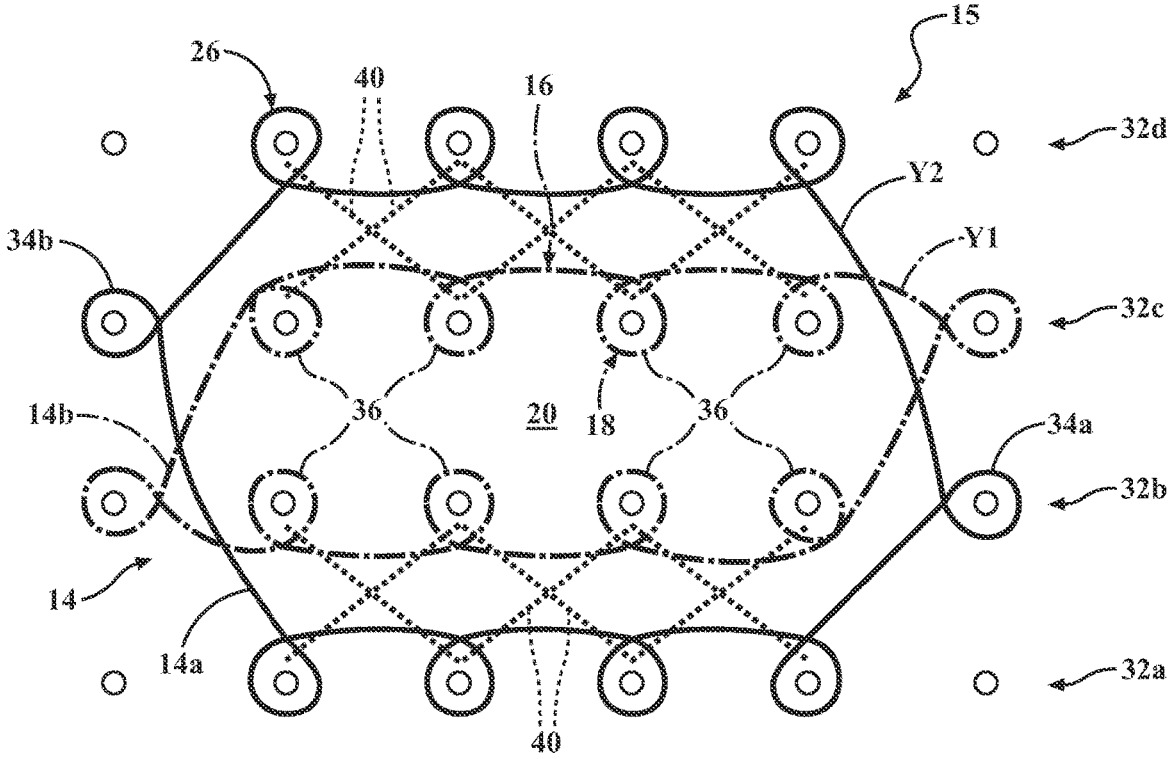
FIG. 2 is a schematic representation illustrating yarns, which form separate tubular walls in axially and radially aligned relation with one another and an intermediate yarn connecting the separate tubular walls to one another, being knit on a four-bed weft knitting machine to construct the knitted tubular sleeve of FIG. 1.

Referring in more detail to the drawings, FIG. 1 illustrates a tubular sleeve 10 for providing protection about an elongate member 12 to be protected against thermal conditions, environmental elements, abrasion, crush protection and dielectric protection. The sleeve 10 is protective in that it provides a thermal barrier, particularly against extreme heat and flame, which is particularly important in applications such as protecting a bus bar 12 interconnecting adjacent cells of an EV battery pack. The sleeve 10 also provides protection against environmental contaminants from entering and/or damaging the sleeve 10 or the elongate member 12 within the sleeve 10, such as against impact resistance from stone impingement or the like, abrasive debris or surfaces and liquid contaminants, e.g. fuel, oil, water. The sleeve 10 has an integral, single piece tubular knitted wall 14, which includes a knitted outer wall 14*a* and a knitted inner wall 14*b* surrounded and covered by the outer wall 14*a*. The outer and inner walls 14*a*, 14*b* are knitted together in a single knitting process via a four-bed weft knitting machine 15, as represented in FIG. 2 via a first bed of needles 32*a*, a second bed of needles 32*b*, a third bed of needles 32*c*, and a fourth bed of needles 32*d*. Thus, the finished wall 14 is seamless, and the sleeve 10 can be readily handled as a single product and does not require secondary stitching processes to join the outer and inner walls 14*a*, 14*b* to one another. In the non-limiting embodiment illustrated, the outer wall 14*a* is knit predominately on the first bed 32*a* and the fourth bed 32*b*, while the inner wall 14*b* is knit predominately on the second bed 32*b* and the third bed 32*c*. A single knit stitch 34*a* on one side of the outer wall 14*a* is shown knit on a needle of the second bed 32*b*, and a single knit stitch on an opposite side of the outer wall 14*a* is shown knit on a needle of the third bed 32*b*, but otherwise, the outer wall 14*a* is knit on the first and fourth bed of needles 32*a*, 32*d*. In contrast, the inner wall 14*b* is shown knit entirely on the second and third bed of needles 32*b*, 32*c*.

As best shown in FIGS. 1B and 2, the knitted inner wall 14*b* is seamless and circumferentially continuous, having an outer surface 16 and an inner surface 18. The inner surface 18 bounds a cavity 20 that extends lengthwise along a longitudinal central axis 22 between opposite inner ends 24*a*, 24*b* of the knitted inner wall 14*b*. The inner wall 14*b* is knitted entirely with a first yarn Y1, with the first yarn Y1 forming interlinked inner knitted stitches 36. The inner wall 14*b* is knitted entirely with heat-resistant multifilament yarn that is suitable for withstanding extreme temperature environments ranging from between about 60 to 1400 degrees centigrade. The selected multifilament yarn can be formed entirely by mineral fiber materials, such as silica, fiberglass, ceramic, basalt, slate, slag, aramid or carbon, by way of example and without limitation. The mineral fibers can be provided having a continuous or chopped fiber structure. In some applications of extreme heat, it may be desirable to heat treat the sleeve material to remove organic content therefrom, thereby increasing even more the heat resistance capacity of the sleeve 10.

The knitted outer wall 14*a* is seamless and circumferentially continuous, having an outer surface 26 and an inner surface 28. The knitted outer wall 14*a* extends lengthwise about the longitudinal central axis 22 between opposite outer ends 30*a*, 30*b*, in overlying relation with the knitted inner wall 14*b*. The outer ends 30*a*, 30*b* are knitted being radially aligned with the opposite inner ends 24*a*, 24*b* in flush or substantially flush (meaning that to the naked eye, they appear flush, but could be a few millimeters different) relation with one another. The outer wall 14*b* is knitted entirely with a second yarn Y2 forming interlinked outer knitted stitches 38. The second yarn can be the same type of yarn as the first yarn, or a different type of yarn, as desired for the application. Accordingly, the yarn used to knit the outer wall 14*a* can have the same resistance to heat or less resistance to heat than the yarn used to knit the inner wall 14*b*, depending on the application needs. As such, it is contemplated that a yarn more well suited to withstand abrasion and impact from external debris can be used to construct the outer wall 14*a*, thereby resulting in the sleeve 10 being both able to withstand abrasion and debris from external sources via the outer wall 14*a* with significant damage thereto, while also being resistance to extreme heat, while providing dielectric protection. Some yarns believed to be suitable for providing increased abrasion resistance to the outer wall 14*a* include polyester, nylon, polypropylene, polyethylene, acrylic, cotton, rayon, and fire retardant (FR) versions of all the aforementioned materials, as desired for the intended application. In addition to the aforementioned materials, if desired, it is contemplated that the same mineral fiber yarn(s) used to construct the inner wall 14*b*, or different mineral fiber yarn(s), could be used to construct the outer wall 14*a*.

During the knitting process, the outer wall 14*a* is knitted integrally with the inner wall 14*b* via an intermediate yarn 40 extending back and forth between the knitted loops of the outer wall 14*a* and the knitted loops of the inner wall 14*b* via a tuck stitch to connect the knitted outer wall 14*a* and the knitted inner wall 14*b* to one another. The intermediate yarn 40, extending through loops of the outer wall 14*a* and the inner wall 14*b* is the sole connection of the outer wall 14*a* to the inner wall 14*b*, thereby physically coupling and preventing separation of the outer wall 14*a* from the inner wall 14*b*. Accordingly, in the absence of the intermediate yarn, the outer wall 14*a* and the inner wall 14 would be separable from one another. The intermediate yarn 40 can be provided as a monofilament yarn having an increased stiffness relative to the multifilament yarn used for the outer and inner walls 14*a*, 14*b*. Having an increased relative stiffness facilitates maintaining the wall 14 having a cylindrical shape. In accordance with another aspect, the intermediate yarn 40 can be provided as a heat-settable yarn, such that upon forming the wall 14 into a desired cylindrical shape, whether a right circular cylinder, rectangular cylinder, or other prismatic-shaped cylinder, the heat-settable yarn can be heat-set to impart of bias on the knitted outer wall 14*a* and inner wall 14*b* to maintain the wall 14 having the desired shape and contour along its length, extending uniformly from one end to the opposite end of the wall 14.

The type of knit stitches used to construct the outer and inner walls 14*a*, 14*b* can be varied, as desired, for the intended application, but regardless of the type of knit stitch, the stitches are formed via weft knitted stitches. Accordingly, the wall 14 can be knit using any type or combination of knit stitches, e.g. jersey, interlock, rib forming stitches, or otherwise, such that the outer and inner walls 14*a*, 14*b* may be knit using a single or multiple knit stitch types, wherein the types of knit stitches used to form the outer and inner walls 14*a*, 14*b* can be the same or different from one another. Further, the wall 14 can be constructed having any suitable length and diameter. As will be evident to one possessing ordinary skill in the art, the diameter of the outer wall 14*a* is controlling, as the inner wall 14*b* is constrained by the inner surface 28 of the outer wall 14*a*.

In accordance with another aspect of the disclosure, a method of constructing a tubular sleeve 10 for providing thermal protection about an elongate member 12 is provided. The method includes knitting an inner wall 14*b* having a circumferentially continuous outer surface 16 and a circumferentially continuous inner surface 18, with the circumferentially continuous inner surface 18 bounding a cavity 20 extending lengthwise along a longitudinal central axis 22 between opposite inner ends 24*a*, 24*b* of the knitted inner wall 14*b* on two separate beds 32*b*, 32*c* of a four-bed weft knitting machine 15. Further, knitting an outer wall 14*a* having a circumferentially continuous outer surface 26 and a circumferentially continuous inner surface 28 in overlying relation with the inner wall 14*b*, with the knitted outer wall 14*a* extending lengthwise about the longitudinal central axis 22 between opposite outer ends 30*a*, 30*b*, on two separate beds 32*a*, 32*d*, different from the two separate beds 32*b*, 32*c* used to knit the inner wall 14*b*, of the four-bed weft knitting machine 15. Further yet, knitting an intermediate yarn 40 back and forth between the outer wall 14*a* and the inner wall 14*b* to connect the outer wall 14*a* and the inner wall 14*b* to one another.

Many modifications and variations of the present invention are possible in light of the above teachings, as will be readily appreciated by one possessing ordinary skill in the art. It is contemplated that all features of all claims and of all embodiments can be combined with each other, so long as such combinations would not contradict one another. It is, therefore, to be understood that the invention may be practiced otherwise than as specifically described, and that the scope of the invention is defined by any ultimately allowed claims.

The invention claimed is:

1. A tubular sleeve for providing thermal protection about an elongate member, comprising:

a knitted inner wall having a circumferentially continuous outer surface and a circumferentially continuous inner surface, the circumferentially continuous inner surface bounding a cavity extending lengthwise along a longitudinal central axis between opposite inner ends of the knitted inner wall;

a knitted outer wall having a circumferentially continuous outer surface and a circumferentially continuous inner surface, the knitted outer wall extending lengthwise about the longitudinal central axis between opposite outer ends, the knitted outer wall overlying the knitted inner wall; and an intermediate yarn extending back and forth between the knitted outer wall and the knitted inner wall to connect the knitted outer wall and the knitted inner wall to one another with the circumferentially continuous outer surface of the inner wall engaging the circumferentially continuous inner surface of the outer wall.

2. The tubular sleeve of claim 1, wherein the knitted inner wall is knitted entirely with a first yarn forming interlinked inner knitted stitches and the knitted outer wall is knitted entirely with a second yarn forming interlinked outer knitted stitches, the inner knitted stitches not knitted to the outer knitted stitches.

3. The tubular sleeve of claim 2, wherein the intermediate yarn is the sole connection of the knitted inner wall to the knitted outer wall.

4. The tubular sleeve of claim 3, wherein the intermediate yarn is knitted with a tuck stitch.

5. The tubular sleeve of claim 4, wherein the inner knitted stitches and the outer knitted stitches are formed using weft knitted stitches.

6. The tubular sleeve of claim 5, wherein the weft knitted stitches are jersey stitches.

7. The tubular sleeve of claim 2, wherein the first yarn and the second yarn are multifilaments.

8. The tubular sleeve of claim 7, wherein the first yarn and the second yarn are different types of material.

9. The tubular sleeve of claim 7, wherein the multifilaments consist of at least one of, fiberglass, ceramic, basalt, silica, slate, slag, aramid and carbon.

10. The tubular sleeve of claim 7, wherein the intermediate yarn is a monofilament.

11. The tubular sleeve of claim 10, wherein the monofilament is heat-set to impart a bias on the knitted inner wall and the knitted outer wall to maintain a predetermined shape.

12. The tubular sleeve of claim 1, wherein the opposite inner ends are radially aligned with the opposite outer ends in substantially flush relation.

* * * * *